US005701684A

United States Patent [19]

Johnson

[11] Patent Number: 5,701,684

[45] Date of Patent: Dec. 30, 1997

[54] LINT COLLECTOR FOR CLOTHES DRIER

[75] Inventor: Hugh Griffith Johnson, Parnell, New Zealand

[73] Assignee: Fisher & Paykel Limited, Auckland, New Zealand

[21] Appl. No.: 615,218

[22] PCT Filed: Sep. 15, 1994

[86] PCT No.: PCT/NZ94/00094

§ 371 Date: Jun. 21, 1996

§ 102(e) Date: Jun. 21, 1996

[87] PCT Pub. No.: WO95/08016

PCT Pub. Date: Mar. 23, 1995

[30] Foreign Application Priority Data

Sep. 15, 1993 [NZ] New Zealand ..... 248667

[51] Int. Cl.[6] ..... F26B 11/02

[52] U.S. Cl. ..... 34/595; 34/82; 34/85

[58] Field of Search ..... 34/82, 85, 595, 34/604; 55/289, 295, 296, 385.1

[56] References Cited

U.S. PATENT DOCUMENTS

| | | | |
|---|---|---|---|
| 2,925,664 | 2/1960 | Cobb et al. | 34/82 |
| 3,648,381 | 3/1972 | Fox | 34/82 |
| 3,966,441 | 6/1976 | Freze | 55/487 |
| 4,314,409 | 2/1982 | Cartier et al. | 34/604 |
| 4,462,170 | 7/1984 | Burkall et al. | 34/82 |
| 4,557,058 | 12/1985 | Ozawa et al. . | |
| 4,673,502 | 6/1987 | Fox | 55/296 |
| 4,700,492 | 10/1987 | Werner et al. | 34/82 |

FOREIGN PATENT DOCUMENTS

| | | |
|---|---|---|
| 0395484 | 10/1990 | European Pat. Off. . |
| 006141 | 1/1984 | Japan . |
| 123590 | 5/1991 | Japan . |
| 68791 | 3/1993 | Japan . |

OTHER PUBLICATIONS

PCT Search Report.

*Primary Examiner*—Henry A. Bennett
*Assistant Examiner*—Dinnatia Doster
*Attorney, Agent, or Firm*—Trexler,Bushnell, Giangiorgi & Blackstone, Ltd.

[57] ABSTRACT

A rotating drum clothes drier has an annular lint filter which rotates with the drier drum and which encircles the drier door. Heated air enters an inlet at one end of the drum, passes through the clothes in the drum (picking up lint from the clothes), through the annular lint filter and out of the drier. During operation, lint collects on the inner surface of the rotating filter, eventually building up to form a felted layer. A scraper blade fixed to the drier cabinet and aligned with (but displaced a fixed distance from) the surface of the filter peels the felted layer of lint from the filter once the thickness of the felt is such that the scraper blade contacts the lint felt. The layer of lint felt thus removed from the filter surface is then collected in a cavity within the drier door for storage and later disposal.

9 Claims, 2 Drawing Sheets

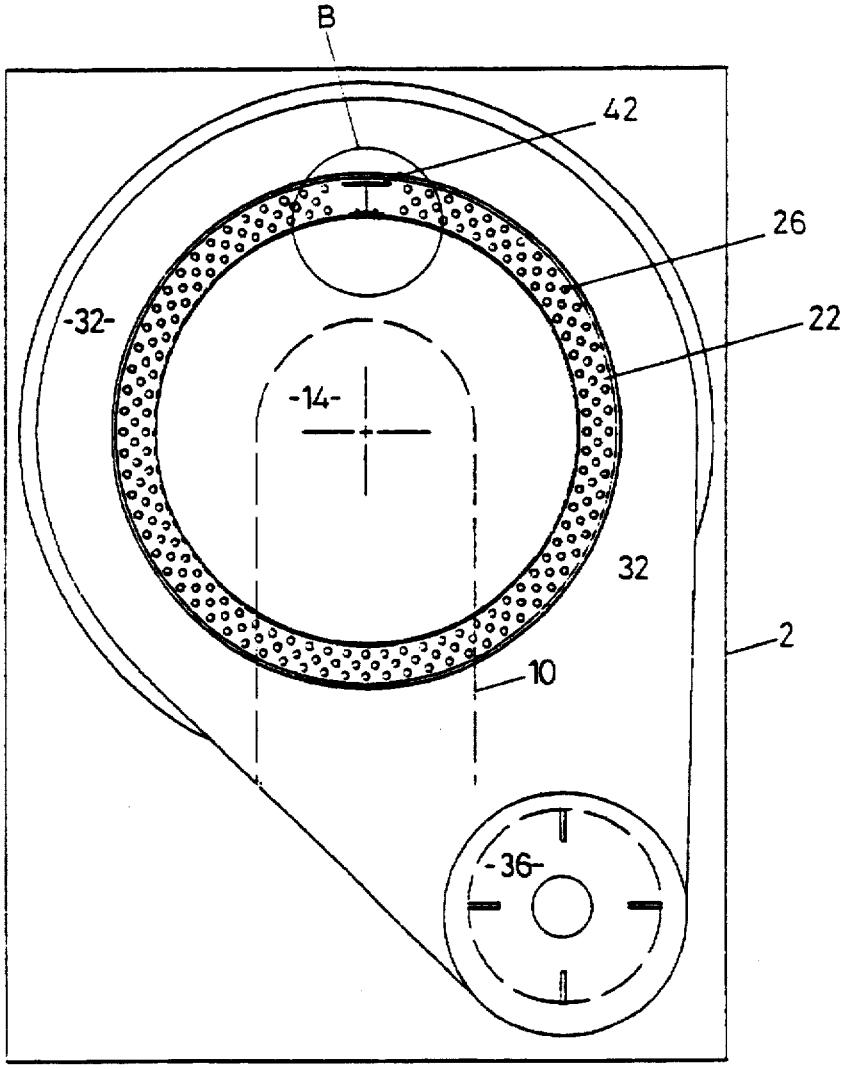
FIG 3
FIG 4
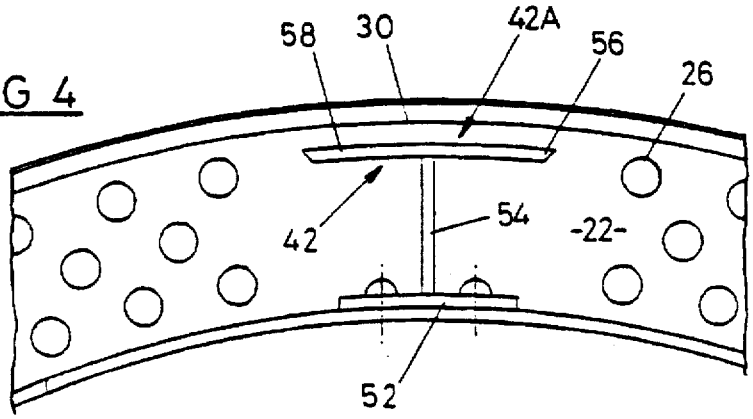

LINT COLLECTOR FOR CLOTHES DRIER

TECHNICAL FIELD

This invention relates to clothes driers, in particular to the collection and removal of lint during the drying process.

BACKGROUND ART

In clothes driers of the type having a rotatable drum through which heated or unheated air is forced to flow to dry clothes, lint removal systems usually comprise a filter located in or adjacent to an air outlet from the drum. In New Zealand Patent No. 218568 the lint filter is provided in a duct through which air from the rotatable drum exits the clothes drier cabinet. The lint filter is removable so that it can be emptied by a user and replaced when required.

The disadvantages of the construction disclosed in New Zealand Patent No. 218568 are that the filter needs to be emptied and cleaned of lint regularly because it does not have a large capacity for lint collection. A reduced airflow may lead to heat build ups which can damage the clothes or the heating element.

A laundry drying machine having a serf cleaning lint filter is disclosed in EP 0045288A1 to MEA. This laundry drying machine has a main filter adjacent to an air outlet from the rotatable drum, the outlet being located about the circumference of the doorway of the machine. The main filter is in use cleaned of lint by the action of the clothes being dried in the machine. The lint removed by the action of the clothes is then disposed in an auxiliary filter located in a position which cannot be accessed by the laundry. The drier disclosed in EP 0045288A1 is unlikely to have problems with reduced airflow due to the filter being covered with lint. However, there is a likelihood of clothes in the machine being covered with some lint, particularly as the auxiliary filter has a small capacity. Also, the auxiliary filter stores the lint in the path of at least some of the airflow through the drier.

DISCLOSURE OF THE INVENTION

It is an object of the present invention to provide a clothes drier which will go some way towards overcoming the above disadvantages, or which will at least provide the public with a useful choice.

Accordingly, in one aspect the invention may broadly be said to consist in a clothes drying machine comprising a rotatable drum for receiving clothes to be dried, said drum having an air inlet and an air outlet, air movement means to cause air flow into said air inlet and through said drum and out said air outlet, a lint filter adjacent to said air outlet having a lint receiving surface for receiving lint entrained in said airflow from said clothes, a container for containing lint removed from said surface, a lint removal member provided in a passageway leading to said container adjacent to or in contact with a part of said lint receiving surface, said lint removal member and said lint receiving surface being moveable relative to each other by rotation of said drum for removing lint from said surface by a scraping or peeling action, the removed lint then being collected in said container for manual disposal.

In a further aspect the invention may broadly be said to consist in a clothes drying machine having a drum, rotated by a motor, for receiving clothes to be dried wherein a heated airflow is passed through said drum characterised in that said airflow leaving said drum is passed through a lint filter having a surface on which lint entrained in said airflow is received, the lint is scraped or peeled from said filter surface and the lint scraped from said surface is collected for subsequent removal.

The invention consists in the foregoing and also envisages constructions of which the following gives examples.

BRIEF DESCRIPTION OF THE DRAWINGS

One preferred form of the present invention will now be described with reference to the accompanying drawings in which;

FIG. 3 is a diagrammatic front elevation of a clothes drying machine in accordance with the present invention, and FIG. 4 is an enlarged view of that portion of FIG. 3 within area "B".

BEST MODE FOR CARRYING OUT THE INVENTION

Figure 1:
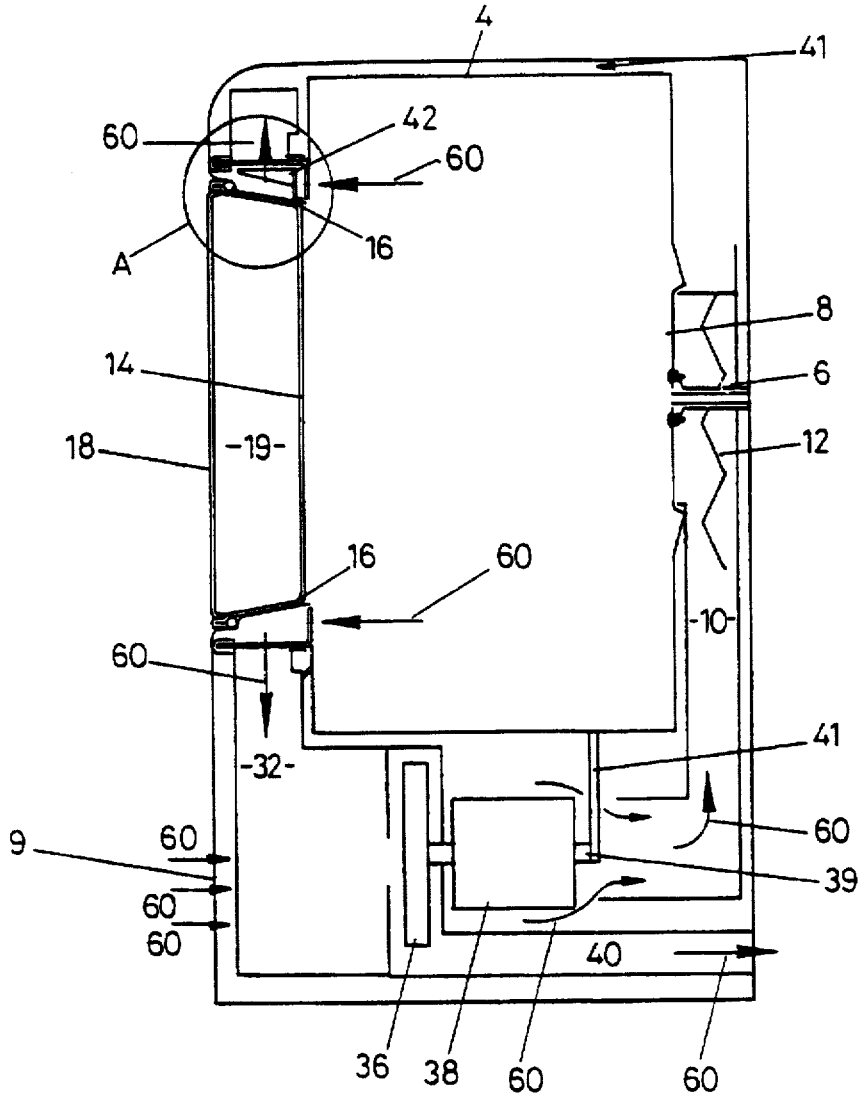
FIG. 1 is an elevation in cross section according to the present invention.

Referring to the drawings, a clothes drying machine is shown in FIG. 1 generally referenced 1 has a cabinet 2 in which a rotatable drum 4 is mounted relative to the cabinet 2 by a bearing 6. The drum 4, which is constructed of steel for example, has an air inlet 8. An inlet 9 is also provided which allows air to enter the cabinet to be provided to an inlet duct 10 so that air may enter the drum 4. The air inlet 9 allows incoming air to pass around the outside of duct 32 and about a motor 38 before the incoming air enters inlet duct 10. In this way the excess heat from the motor 38 and outlet duct 32 is used to assist in heating the incoming air. A heating element 12 is provided in duct 10 adjacent to inlet 8. The heating element is preferably an electric heating element provided in the clothes drier in the known way.

Figure 2:
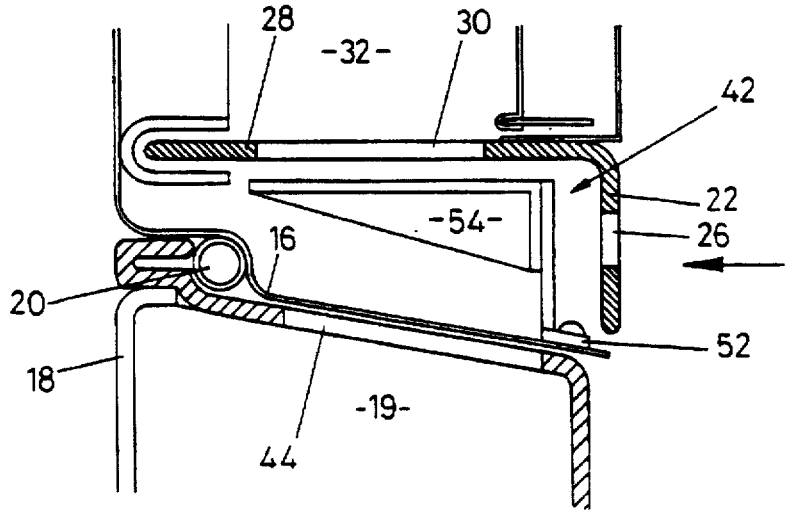
FIG. 2 is an enlargement elevation in cross section of that portion of FIG. 1 within area "A"

The drum 4 also has an air outlet 14. In use the central part of outlet 14 is blocked by a door 18. The walls 16 of the cabinet 2 define an opening in the cabinet in which the door 18 is provided which may be used by a user to access the inside of the rotatable drum 4 so that clothes may be placed in or removed from the drum. The door 18 is preferably hinged to the cabinet 2 at one side thereof and has a sealing member 20 about an edge thereof so that when closed the door 18 makes a substantially airtight seal with the cabinet 2. The periphery of the air outlet 14 of the drum has a first filter member 22 coaxially located thereon. Referring to FIG. 2 the filter member 22 comprises a substantially annular, ring like member constructed of a plastics material for example. The filter member 22 is disposed in a substantially vertical plane and has a plurality of apertures 26 therein each aperture being 5 mm in diameter for example. Apertures 26 allow air to flow through filter 22 but are of a sufficiently small size to prevent clothes within the drum from exiting the drum. The holes 26 therefore act as a coarse filter so that only small particles of material such as lint pass therethrough. A further substantially short cylindrical filter member 28 is provided, extending coaxially from the drum, the filter 28 having a fine filter mesh 30 disposed therein. An annular duct 32 is provided within the cabinet 2 located circumferentially adjacent to the filter member 28. Duct 32 leads to and is in fluid connection with an impeller 36 which is rotatably connected to electric motor 38. The shape of duct 32 is shown more clearly with reference to FIG. 3. A further duct 40, also in fluid connection with impeller 36, provides an air outlet from the cabinet 2.

A lint removal member 42 is provided attached to inner wall 16 of the cabinet and is located substantially above a gap 44 which provides a passageway through wall 16 and into door 18.

FIGS. 3 and 4 show the lint removal member 42 in further detail.

Referring to FIG. 4, the lint removal member 42 is shown as comprising a mounting member 52, a vertical support 54, scraper blades 56 and 58. The lint removal member 42 is preferably constructed from plastics material. The blades 56 and 58 are arranged in contact with or preferably closely adjacent to the filter mesh 30. FIG. 4 shows an enlarged space 42A between mesh 30 and blades 56 and 58 for clarity.

The use and operation of the present invention will now be described with reference to the drawings and the foregoing description. When a user initiates operation of the drying machine 1, motor 38 is operated together with the heating element 12. Operation of the motor 38 causes impeller 36 to rotate and to draw air from outside the cabinet 2 and through the drum 4 as indicated by arrows 60. Air enters the inlet duct 10 from external opening 9 in cabinet 2 and proceeds through to duct 10 as previously described to pass over the heating element 12 which heats the incoming air. The air enters the drum 4 through air inlet 8 and proceeds across the drum towards outlet 14. The heated air dries the clothes within the drum 4 in the known way. The electric motor 38 has an extended shaft portion 39 which drives a belt 41 disposed about an outer surface of drum for rotating the drum. The drum 4 rotates in the known way to expose the clothes within the drum to the flow of air therethrough. During operation the door 18 is in the closed position so that the air exit from the drum 4 is by means of apertures 26 in the filter member 22. Air together with lint particles from the clothes being dried pass through the apertures 26 and then out into duct 32 through the filter surface comprising mesh 30 of the filter 28. The mesh 30 allows air to pass therethrough but substantially prevents the transfer of lint particles which remain on the inner surface of the mesh 30 about the circumference of the filter. As the drum 4 rotates the inner surface of mesh portion 30 rotates over one of the scraper blade portions 56 or 58 (FIG. 2) of the lint removal member 42 so that the edges of one of the blades scrape lint off the filter surface. In FIG. 4 blade 56 will remove lint when the drum is rotating in an anticlockwise direction and blade 58 will remove lint from the filter surface when the drum is rotating in a clockwise direction. Lint builds up on the inner surface of the filter mesh 30 until a scraping or peeling action by either blade 56 or 58 (depending on direction of rotation) causes a felted layer of lint to be scraped or peeled off, the thickness of the layer depending on the separation of the blades from the mesh 30 and the frictional effect of the respective blade on the still rotating layer of lint. Lint is scraped or peeled by scraper blades 56 or 58 from the inner surface of the mesh 30 and either falls directly through aperture 44 into the hollow inner cavity 19 of the door 18 or impacts the supporting wall 54 and then falls by gravity through aperture 44 in the cabinet wall 16 and the door 18 to be contained within the hollow inner cavity 19 of the door. The air from the drum once it has passed through the mesh 30 into duct 32 then passes through the impeller 36 and into duct 40 after which it exits the cabinet 2.

The present invention provides considerable advantages over present lint removal or collection systems provided in clothes drying machines. The mesh 30, if it is provided in a continuous portion about the annular part 28 of the filter provides a very large area through which air can exit the drum 4. Thus there is a large area of the filter over which lint can accumulate and lint is effectively being removed by one or other of the scraping blades (depending upon direction of rotation of the drum which may alternate during drying cycles). Therefore there is a large and clear air passage for air to exit the drum. In this way more air can pass through the drum to allow the clothes to dry more efficiently, the filter does not clog and the motor becomes more efficient because there is less energy required to be input to the motor to circulate air through the drum. Furthermore, because a larger volume of air will circulate in the drum, there is less risk of the heater element 12 overheating and there will be less heat build up within the drum 4 so that there is a reduced risk of damage to the clothes within the drum.

A further significant advantage provided by the present invention, at least in the preferred form is that a large volume of the hollow interior of the door 18 allows a large volume of lint to accumulate within the door 18 before emptying of the door is required. The door is preferably constructed of a transparent plastics material for example so the user can visually determine the volume of lint which has been collected. It is estimated that a user, under normal domestic conditions, is likely to only need to empty the door once per month. As can be seen, lint may be allowed to collect in the door for a long period of time because, unlike known lint collection or removal systems, the accumulation of lint does not affect the performance of the drying machine.

I claim:

1. A clothes drying machine comprising a rotatable drum for receiving clothes to be dried, said drum having an air inlet and an air outlet, air movement means to cause air flow into said air inlet and through said drum and out said air outlet, a lint filter extending coaxially from said drum so as to rotate therewith about a circumference of said air outlet and adjacent to said air outlet having a lint receiving surface for receiving lint entrained in said airflow form said clothes, a container for containing lint removed from said surface, a stationary lint removal member provided in a passageway leading to said container adjacent to or in contact with a part of said lint receiving surface, said lint removal member and said lint receiving surface being moveable relative to each other by rotation of said drum for removing lint from said surface by a scraping or peeling action, the removed lint then being collected in said container for manual disposal.

2. A clothes drying machine as claimed in claim 1 wherein said lint removal member comprises a scraper which scrapes lint from said filter surface.

3. A clothes drying machine as claimed in claim 1 or claim 2 wherein said container is provided in a door of said machine.

4. A clothes drying machine as claimed in claim 1 or claim 2 wherein said outlet is provided adjacent to a peripheral edge of said door and is substantially continuous about the circumference of said peripheral edge.

5. A clothes drying machine as claimed in claim 2 wherein said scraper is located adjacent to an entrance to said container so that lint is scraped or peeled from said filter surface into said container.

6. A clothes drying machine as claimed in claim 1 or claim 2 wherein said air movement means comprises an electric motor and air provided to said air inlet has been passed through or about said motor to remove heat generated by said motor.

7. A clothes drying machine having a drum, rotated by a motor, for receiving clothes to be dried wherein a heated airflow is passed through said drum characterised in that said airflow leaving said drum is passed through a lint filter having a surface on which lint entrained in said airflow is received, wherein said lint filter is on annular cylindrical filter, co-axial with the dram of said drying machine and wherein lint is scraped or peeled from said surface by rotating said lint filter against a lint removal member and the lint scraped from said surface is collected for subsequent removal.

8. A clothes drying machine as claimed in claim 7 or claim 9 wherein said clothes drying machine includes a door to provide access to the drum of said drying machine and a container is associated with said door and wherein lint scraped from said filter surface is deposited in said container.

9. A clothes drying machine as claimed in claim 7 or claim 9 wherein said airflow is caused to pass through or about said motor to remove heat generated by said motor.

* * * * *

UNITED STATES PATENT AND TRADEMARK OFFICE

CERTIFICATE OF CORRECTION

PATENT NO. : 5,701,684
DATED : December 30, 1997
INVENTOR(S) : Hugh Griffith Johnson It is certified that error appears in the above-indentified patent and that said Letters Patent is hereby corrected as shown below:

Column 1, Line 23 "serf" should be -- self --

Column 5, Line 2 "on" should be -- an --

Column 5, Line 3 "dram" should be -- drum --

Column 5, Line 9 please delete "or claim 9"

Column 6, Line 4-5 please delete "or claim 9"

Signed and Sealed this

Twenty-fourth Day of November, 1998

*Attest:*

Bruce Lehman

BRUCE LEHMAN

*Attesting Officer*

*Commissioner of Patents and Trademarks*